US005608934A

United States Patent [19]

Torrie et al.

[11] Patent Number: 5,608,934

[45] Date of Patent: Mar. 11, 1997

[54] HIP DISTRACTOR

[75] Inventors: Paul A. Torrie, Marblehead, Mass.; Graham Smith, Plaistow, N.H.

[73] Assignee: Smith & Nephew Dyonics, Inc., Andover, Mass.

[21] Appl. No.: 319,970

[22] Filed: Oct. 6, 1994

[51] Int. Cl.[6] ..... A47B 7/00

[52] U.S. Cl. ..... 5/624; 5/648

[58] Field of Search ..... 5/624, 648; 606/242; 602/32, 33

[56] References Cited

U.S. PATENT DOCUMENTS

| | | | |
|---|---|---|---|
| 1,118,973 | 12/1914 | Troesch | 5/648 |
| 2,204,266 | 6/1940 | Wilcox | 5/624 |
| 2,374,163 | 4/1945 | Burchsted | 602/32 |
| 2,375,225 | 5/1945 | Herbert | 5/648 |
| 2,581,110 | 1/1952 | Kenworthy | 5/648 |
| 3,087,489 | 4/1963 | Gilbert et al. | 128/84 |
| 3,766,384 | 10/1973 | Anderson | 5/624 |
| 3,850,166 | 11/1974 | Tamny et al. | 128/84 C |
| 4,782,827 | 11/1988 | Paratte | 5/648 |
| 4,890,605 | 1/1990 | Rosendale | 602/33 |
| 5,027,799 | 7/1991 | Laico et al. | 128/75 |
| 5,162,039 | 11/1992 | Dahners | 602/32 |
| 5,290,220 | 3/1994 | Guhl | 602/32 |
| 5,312,323 | 5/1994 | McAninch | 602/32 |

OTHER PUBLICATIONS

"Concept Traction Tower™ Extremity Traction Device", Orthopedics, Oct. 1989 vol. 12/No. 10.

"Hip Joint", Arthroscopic Surgery: Principles and Practice, Chapter 19, pp. 1491–1495.

*Primary Examiner*—Michael J. Milano

*Attorney, Agent, or Firm*—Pravel, Hewitt, Kimball & Krieger

[57] ABSTRACT

An apparatus and method for positioning a leg during surgery has a support for holding a substantial portion of one of the patient's legs on the side facing the other leg and a pivot located in the proximity of the patient's pelvis. After patient's pelvis is secured relative to the operating table, the distal end of the support can be moved for adjustment of the outer extremity of the patient's leg relative to the operating table to selectively position the leg relative to the patient's pelvis.

63 Claims, 5 Drawing Sheets

HIP DISTRACTOR

BACKGROUND OF THE INVENTION

1. Field of the Invention

This invention relates to an apparatus and method useful for positioning a patient's leg during hip surgery and, more particularly, to an improved leg support and displacement system for use with arthroscopic observation equipment.

2. Description of the Related Art

Surgery on a hip joint, which is deep within surrounding tissue, is best planned when the surgeon has been able to observe bones that make up the joint and their position and condition. This observation is possible through diagnostic arthroscopic surgery which has proven beneficial to patients because it allows surgeons to visualize most areas of the acetabulum, ligamentum terras and femoral head. Inspection of the joint surfaces during arthroscopy provides a basis for determining when open osteotomy is a suitable treatment option, which decreases the need for the more radical total hip replacement.

Distraction of the femoral head from the hip joint is necessary to provide the physician with access to the joint. Once the femur is separated from the hip joint, access to various surface aspects of the hip joint and femoral head requires controlled movement of the patient's leg in a full range of motion and fixation of the leg in selected positions. Because of the shape of the femoral head and the depth and tightness of the joint, precise manipulation of the patient's leg to allow sufficient access is difficult to achieve. The soft tissue of the joint and points on the patient's leg that are subject to applied forces during distraction are easily damaged.

Orthopedic limb support and traction devices have been previously suggested for use in manipulating the leg during arthroscopic hip surgery. U.S. Pat. No. 3,087,489 to Gilbert describes an orthopedic device with a T-shaped frame which supports traction and limb holding members. The device is cumbersome and impedes a surgeon's access to the patient's joint.

U.S. Pat. No. 5,027,799 to Laico describes a limb holding device attachable to an operating table to immobilize the patient's arm or leg during arthroscopic or other surgery. An H-shaped frame supports a fork-like limb support member. Force is placed on the perineum and inner thigh with the use of a perennial post mounted to the operating table to separate the femur from the hip joint. Adjustable clamps and a crank and screw are used to manipulate and vary the position of the patient's limb.

The Laico device is difficult to set up, having two major assemblies that require alignment with the operating table and four attachment points to the operating table. Use of a perennial post to separate the femur from the hip joint is believed to cause an invasive point load on the patient's inner thigh, which could affect nerves and blood vessels located in that area and cause possibly tissue damage.

These devices are also troublesome because they allow only limited exposure to the inner surfaces of the hip joint and femoral head. Neither do these devices utilize mechanical advantages with efficiencies designed to increase ease and accuracy in manipulating the leg.

Thus, there is a need for a device that is easy to set up and allows controlled, precise manipulation of the patient's leg to access the inner surfaces of the hip joint and femoral head with minimal tissue damage.

SUMMARY OF THE INVENTION

The present invention is directed to a novel leg positioning apparatus and to a novel method for distracting and positioning the leg of a patient to expose the inner surfaces of the patient's hip joint and femoral head during surgery. The angle of distraction of the patient's leg may be adjusted by the surgeon to minimize the possibility of tissue damage in the hip joint. Forces are evenly applied across a large enough area of the patient's leg to prevent invasive point loads.

The invention also provides for constant rotational and vertical stability to allow precise manipulation of the patient's leg for exposing the surfaces of the hip joint and femoral head. Further, the invention prevents crotch roll and movement of the patient during surgery, and is easier to set up and less costly than known devices.

More specifically, the invention utilizes a cradle-like frame to support one of the patient's legs on the side facing the other leg, while the patient is positioned sideways on an operating table. The frame has its proximal end located on the side of the patient's inner thigh and the distal end located on the side of the patient's foot.

The frame which has a pair of elongated side members connected by a plurality of cross members that support the patient's leg with the leg being strapped in place. The frame extends from the head of the femur to the foot of the patient's supported leg for stability and uniform transmittal of tensional forces throughout the leg.

A high friction pad, constructed of foam or other suitable material, may be placed between the patient and the operating table to prevent patient slippage along the operating table during surgery. The patient's pelvis is secured relative to the operating table, preferably through an arm or strap extending at least partially around the patient's waist.

The frame can be pivoted for moving the patient's leg. In one embodiment, a pair of seating members extend from the frame and engage corresponding vertical notches in a pair of mounting members. The mounting members have a plurality of vertical notches for adjusting the height of the frame.

The distal end of the frame is movable so that the outer end of the patient's supported leg can be adjusted relative to the operating table for separating the patient's leg from the hip joint. In one embodiment, the frame may be pivoted by tensioning a cable releasably connected between the distal end of the frame and the operating table. The mechanical advantage of this configuration reflects the ratio of the distance between the pivot points and the point where the cord connects to the frame and the distance between the pivot points and hip joint.

The position of the leg may also be fixed after it is separated from the hip joint. The end of the tensioned cable that is connected to the support element may be secured to locking means, through a cleat or one-way cable grip.

Further, the patient's leg may be translated axially, relative to the pelvis to distract the leg. A rotatable handle and screw are connected to the frame, the screw extending in its central axis. A threaded sleeve is rotatable on the screw near the proximal end of the support element. As the handle is rotated, the frame is drawn away from the mounting members, for distracting the supported leg from the patient's hip. The angle of distraction of the patient's femur from the hip joint may also be preset before pivoting the support element.

The patient's leg may also be rotated relative to the pelvis to view the inner surfaces of the patient's hip joint and the load bearing surface of the head of the femur by manually rotating the frame. Such rotational manipulation may be achieved by manually twisting the frame to overcome a constant resistance placed on the frame with a tension wire extending between the proximal and distal ends of the support element and the seating members.

Tension measurement and display elements may be provided for determining and indicating the amount of tension placed on the patient's leg during surgery.

An alternative configuration utilizes bar-like frame that supports the patient's leg with a perennial saddle at its proximal end and a foot cuff at its distal end. The perennial saddle may be custom fit to form around the patient's inner thigh for uniform displacement of forces.

A horizontal bar, extending perpendicular to the frame and clamped to the operating table, is mounted on a freely-rotatable connector for pivoting the frame to move the patient's leg. The frame is pivotable about the point where the horizontal bar engages the connector for allowing distraction.

The frame is automatically locked in position by a ratchet incorporated at the pivot point. Axial translation of the patient's leg relative to the hip for distraction can be a screw telescopically engaged in the distal end of the frame and rigidly connected to the foot cuff. Gross translation may be induced by pulling the screw distally with a handle and allowing a pawl connected to the distal end of the frame to automatically engage the most proximally exposed thread of the screw. Additional translation may be induced by rotating a handle connected to the distal end of the screw, allowing the screw to move and lock distally in the grooves of the pawl. The combination of upward force on the patient's femur by pivoting the frame and the axial translation of the patient's leg provides the desired distraction force and angle of distraction at the hip joint.

The patient's leg may also be rotated relative to the pelvis by rotating a handle attached to the distal end of the support element. The handle and frame freely rotate relative to the horizontal bar after being unlocked.

BRIEF DESCRIPTION OF THE DRAWINGS

A better understanding of the invention can be obtained when the detailed description of exemplary embodiments set forth below is reviewed in conjunction with the accompanying drawings, in which.

DETAILED DESCRIPTION OF THE PREFERRED EMBODIMENT

Figure 1:
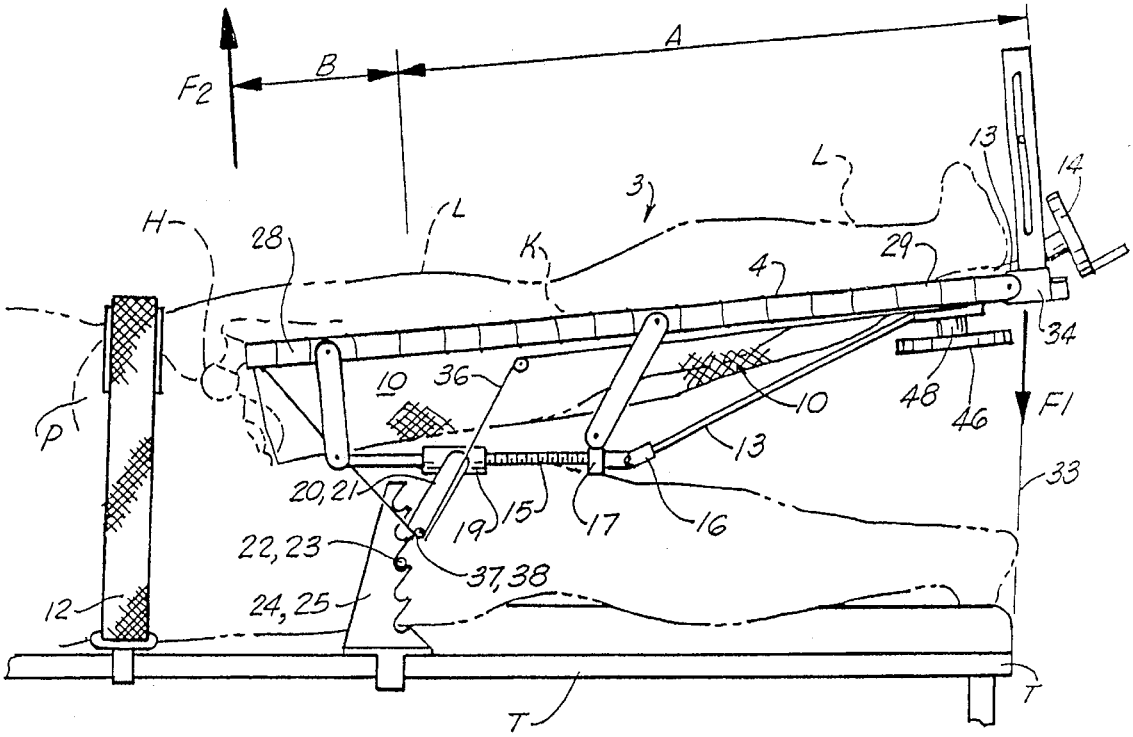
FIG. 1 is a side view of the preferred embodiment of a leg positioning apparatus made in accordance with the invention.

FIGS. 1–6 show the hip distractor apparatus of one embodiment of the present invention, which is identified generally by reference numeral 3 and includes a cradle-like frame 4 constructed of aluminum, steel or similar structural material. The frame 4 includes a pair of elongated side members 5, 6 connected through U-shaped cross members 7, 8 and cross member 9.

Figure 3:
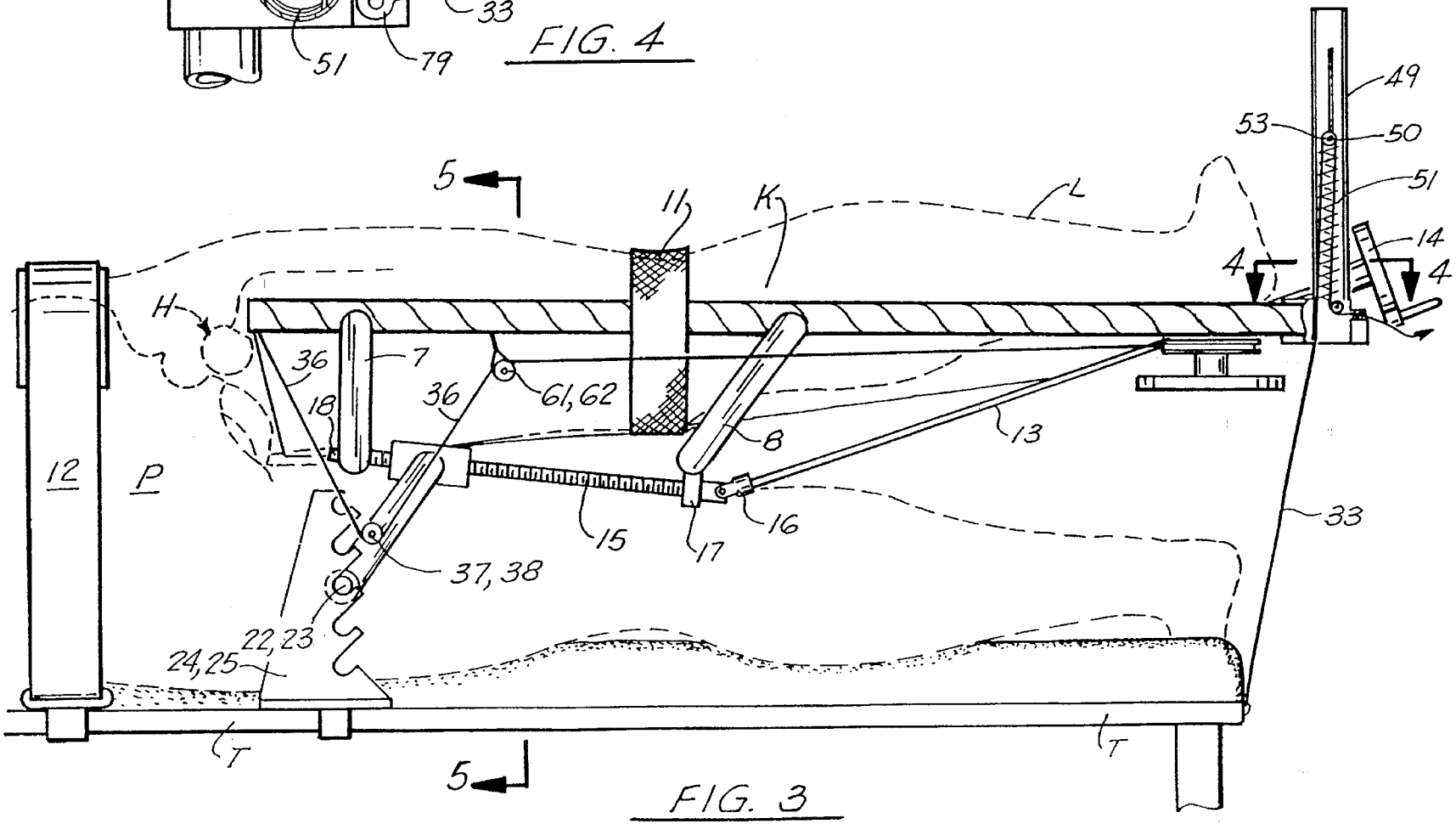
FIG. 3 is a side view of the preferred embodiment of apparatus of the present invention.
Figure 5:
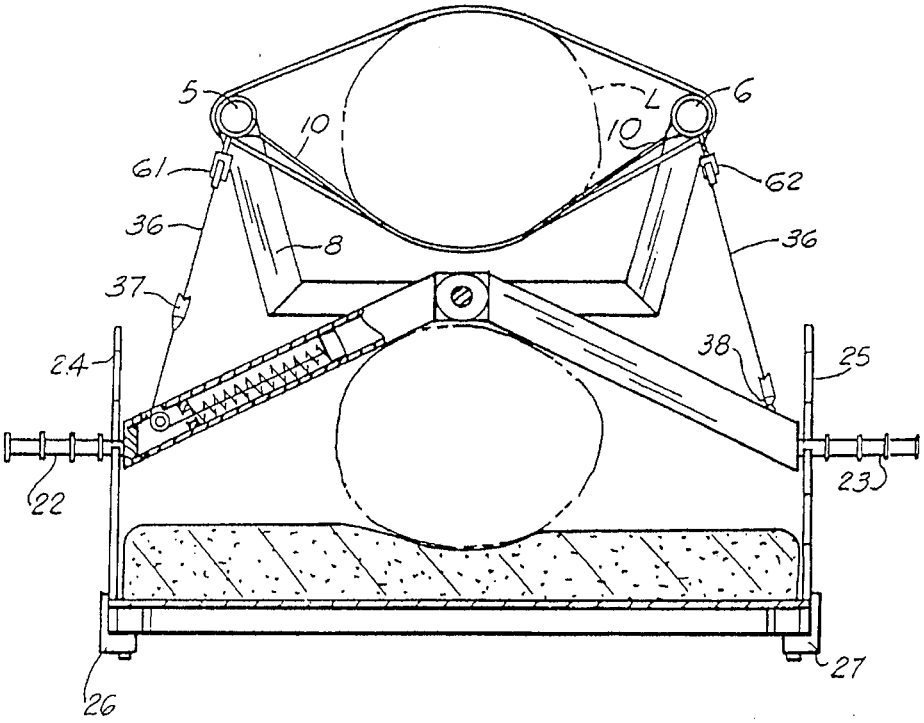
FIG. 5 is a sectional view of the preferred embodiment of the apparatus of the present invention taken along lines 5—5 of FIG. 3.

As shown in FIGS. 3 and 5, the frame 4 is adapted for holding a substantial portion of one leg of a patient on the side facing the other leg, while the patient is positioned sideways on the operating table. A canvas or plastic cradle 10 is stretched between and removably connected with the elongated members 5, 6 of the frame.

The extended leg L of the patient is placed upon and secured to the cradle 10 with one or more removable straps. This method of securement of the patient's leg to the apparatus 3 allows applied forces to be transmitted evenly throughout the leg L. The proximal end 28 of the frame 4 is located near the thigh of the patient's supported leg, while the distal end 29 of the frame 4 is located near the foot of the supported leg L.

The patient's pelvis P is secured to the operating table T with a strap or holder 12, which extends at least partially around the pelvis and is connected to the operating table T. The strap 12 is adjustable to vary the force applied to the patient's pelvis for preventing movement of the patient's pelvis (lifting and/or sliding) relative to the operating table when the patient's leg L is manipulated. In addition, a high friction pad 94 may be placed between the patient and the operating table to prevent patient slippage relative to the table during surgery.

Rotatable bar 13 is supported on the distal end 29 of the frame 4 and extends angularly downward therefrom toward the center portion of Table T. At its distal end, the bar 13 is connected to a rotation handle 14. A universal joint 16 connects the proximal end of bar 13 to threaded screw 15. Screw 15 extends in generally parallel relationship and is generally centrally located with respect to elongated members 5, 6. Screw 15 is secured to the cross member 8 with bushing 17 and to the cross member 7 with a nut at 18.

Figure 2:
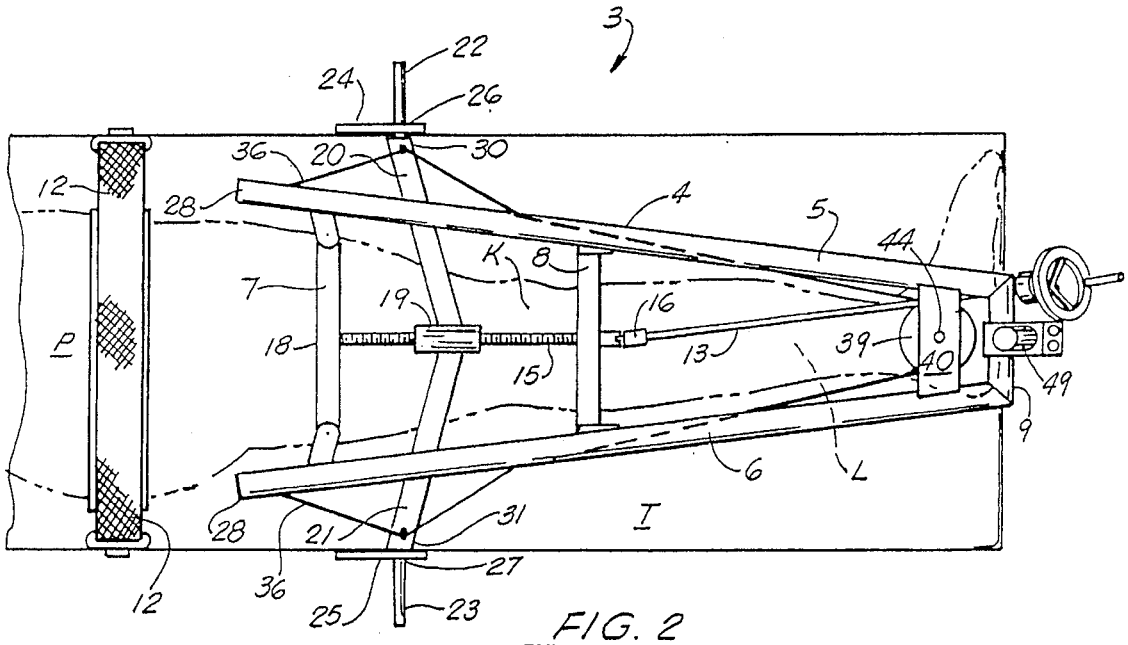
FIG. 2 is a top plan view of the preferred embodiment of the apparatus of the present invention.

Sleeve 19 is located on screw 15 near the proximal end 28 of the frame. Sleeve 19 has an internal bore with female threads that engage external threads of screw 15 so that when the screw 15 is rotated the sleeve travels on the screw 15 between cross members 7 and 8. Seating braces 20, 21 are rigidly connected to opposing sides of sleeve 19, and extend angularly downward therefrom to form an inverted-V (FIG. 2).

The lower ends 30, 31 of the seating braces 20, 21 are adapted to engage a pair of corresponding notches on mounting members 24, 25 at pivot points 22, 23, thus supporting the frame 4 at a position adjacent but distally of the patient's pelvis, (i.e., between the patient's pelvis P and knee joint K). The height of the apparatus 3 relative to the operating table may be adjusted by selectively engaging the lower ends 30, 31 of seating braces 20, 21 in any corresponding pair among a plurality of vertically aligned notches in the mounting members 24, 25. The mounting members 24, 25 may be removably connected to the operating table T with clamps 26, 27.

The lower ends 30, 31 of seating braces 20, 21 may freely rotate upon pivots 22, 23 in the notches of the mounting members 24, 25. Pivot points 22, 23 form a lever fulcrum in the proximity of the pelvis with the length "A" of the primary moment arm equal to the distance between the guide 34 and the pivot points 22, 23 and the length "B" of the secondary moment arm equal to the distance between the pivot points 22, 23 and the patient's hip joint H. An input force (F1) on the distal end 29 of the frame 4 is enhanced by the mechanical advantage of the lever's ratio of transformation, causing a distraction force (F2) equal to [(A/B)×F1].

Figure 4:
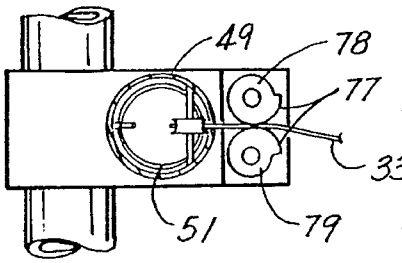
FIG. 4 is a fragmentary view of preferred embodiment of the apparatus of the present invention taken along lines 4—4 of FIG. 3.

Cable 33 is anchored to the operating table T below the distal end 29 of frame 4. Cable 33 engages guide 34 connected to frame 4 at distal end 29. Frame 4 can be pivoted around pivot points 22, 23 when tension is manually applied to the cable 33. When tensioned, cable 33 moves distal end 29 of frame 3 and the outer extremity of the leg downwardly. The resulting upward force at the proximal end 28 of the frame in conjunction with the force of strap 12 on the patient's pelvis results in the separation of the patient's leg L from the hip joint H. Because leg L is cradled with cradle 10, the upward force on the patient's thigh is evenly distributed across the approximate width of the proximal end 28 of the support element, therefore not applying an invasive point load. To hold the patient's leg L in an upwardly pivoted position, the tensioned cable 33 is held by the angled teeth 77 of a pair of one-way cable grips 78, 79 (FIG. 4).

An angle of distraction may be preset to roughly coincide with the angle of the neck of the femur (or to coincide with another desired angle) by rotating wheel 14 to move threaded sleeve 19 along screw 15. This movement minimizes the possibility of tissue damage in the joint.

After separation, the patient's leg may be axially translated relative to the patient's hip by rotating the rotation handle 14 to move the sleeve 19 along the screw 15. As the seating braces 20, 21 move with sleeve 19 away from the patient's pelvis P (immobilized with strap 12), the frame 4 and the patient's supported leg L are displaced in the axial plane of the hip joint to allow exposure of the surface of the hip joint and femoral head.

The patient's supported leg L may be rotated in a wide range of motion relative to the hip joint for further access to various aspects of the hip joint by manually twisting either the elongated arm 5 or 6 of the frame 4. Precise rotational manipulation is achieved by controlling the amount of twisting force applied in relation to the resistance provided when the frame 4 and the seating braces 20, 21 are maintained in constant tension.

A tension wire 36 is anchored to the proximal end 28 of the frame 4 on each elongated member 5, 6 and passed through a series of freely-rotatable pulleys 37, 38 (located on the seating braces 20, 21), and 61, 62 (located on the elongated members 5, 6 in the proximity of cross member 8) and a pulley 39 (located on a plate 40 at the distal end 29 of the frame 4) to maintain the apparatus 3 in constant tension. Other suitable wire guiding devices such as cleats, may be used in place of pulleys.

Figure 6:
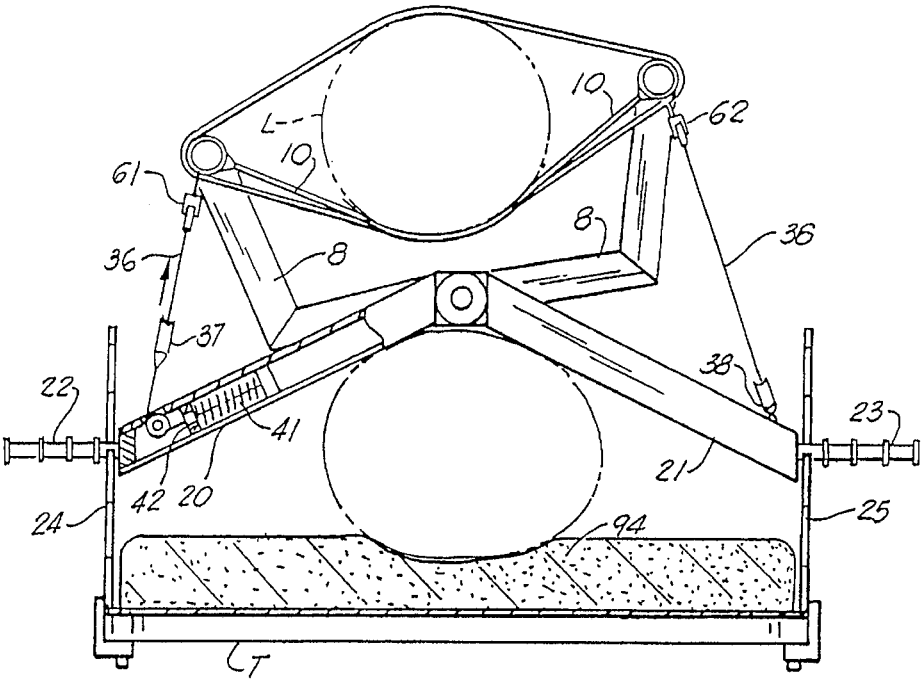
FIG. 6 is another sectional view of the preferred embodiment of the apparatus of the present invention.

As shown in FIG. 6, either the pulley 37 or 38 is connected to a tension spring 41 and a spring compressor 42 located within the member 20 or 21 to which it is attached. The spring compressor 42 may be manually set to establish the desired amount of tension on the wire 36 and apparatus 3.

Wire 36 can optionally be maintained in tension by engaging a swage, which is rigidly attached to the wire 36, in a swage recess formed in the pulley 39 and turning a handle 46 to frictionally lock the pulley 39 in place against the plate 40. The handle 46 is rotatable over a threaded axle 44, which extends from the plate 40 and holds a washer and a bearing 48 between the handle 46 and the pulley 39, and is secured with an axle cap nut.

A tension measurement and display device may be incorporated with the invention for measuring and displaying the tension placed on the patient's supported leg. The tension measurement device may be any electronic or mechanical unit commonly used for tension measurement purposes, such as a load cell or strain gauge device, disposed at any point between the foot of the patient's supported leg and the hip where there are two opposing forces. A display gauge for displaying the measured tension may be incorporated on the measurement device, mounted to the invention or connected with electrical leads for placement near the invention, depending on the type of tension measurement device used.

As shown in FIGS. 3–4, a scale tube 49 with readout can optionally be attached to the distal end 29 of the frame to measure and display the tension placed on the patient's leg when the cable 33 is tensioned. Before passing through guide 34, the cable 33 is passed through a scale pulley 50 that is connected to a pulley axle 53 with a spring 51 on the inside of the scale tube 49. As the cable 33 is tensioned, the spring 51 is compressed along the inside of the scale tube 49. A vertical display window is formed on the outside of scale tube 49 adjacent to a pre-marked incremental scale of potential quantities of applied force to show the level of compression of the spring 51.

Figure 7:
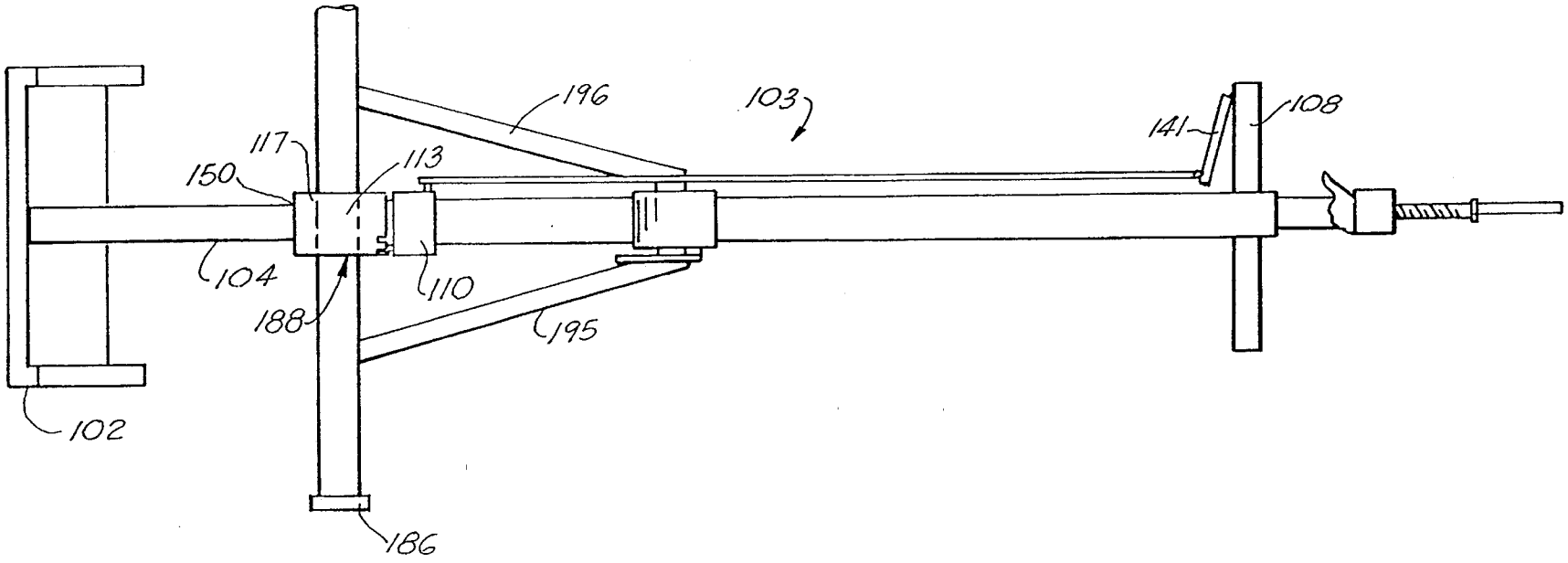
FIG. 7 is a bottom view of a second embodiment of the invention.
Figure 8:
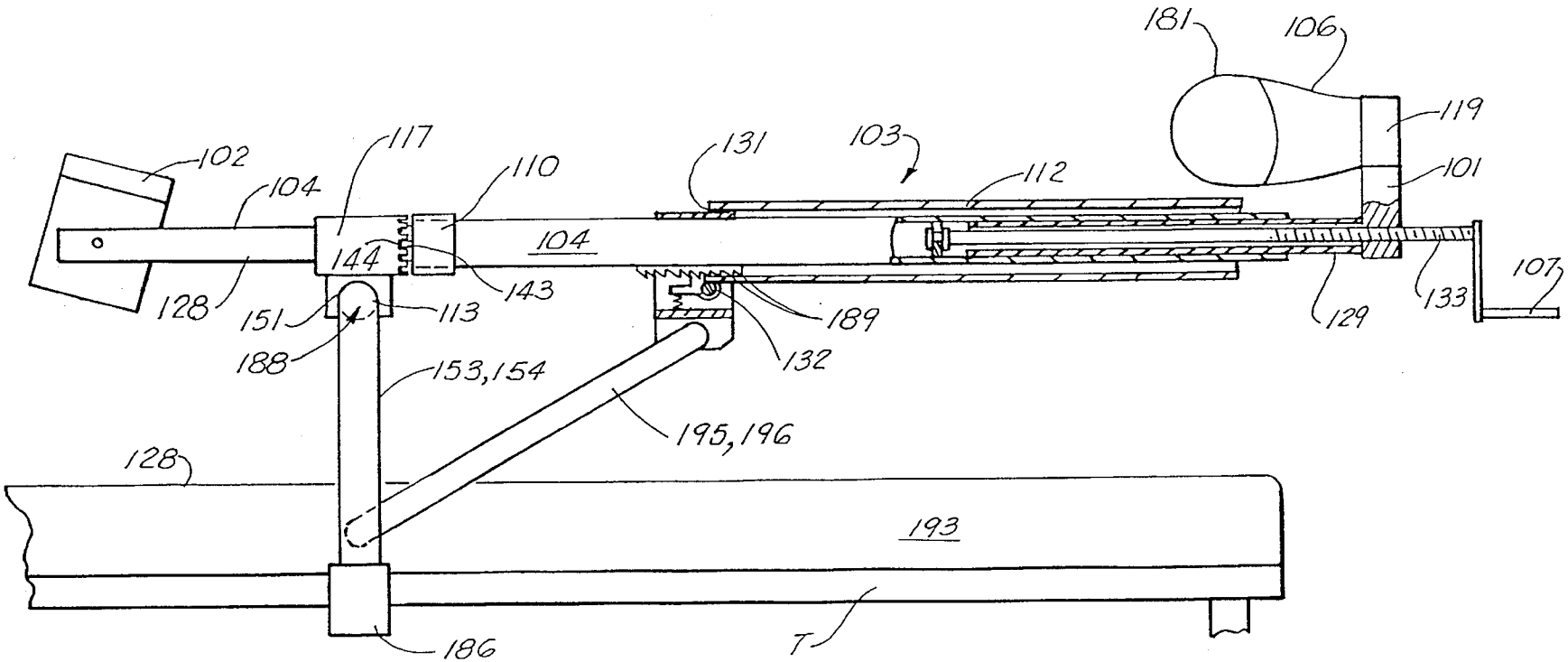
FIG. 8 is a side plan view of the embodiment shown in FIG. 7.

FIGS. 7–8 show the positioning apparatus of a second preferred embodiment, which is identified generally by reference numeral 103 and includes a horizontal bar-like frame 104 constructed of aluminum, steel or similar structural material.

The patient's pelvis is secured to the operating table T with a strap or like holder such as strap 12 in FIGS. 1–2, which extends at least partially around the pelvis and is connected to the operating table. The strap is preferably adjustable to vary the force applied to the patient's pelvis for preventing lifting off or sliding along the operating table when the patient's leg is manipulated. In addition, a high friction pad 193 may be placed between the patient and the operating table to prevent patient slippage along the table during surgery.

While the patient is positioned sideways on an operating table, the foot of the patient's extended leg is connected to the apparatus 103 with a foot cuff 106. Cuff 106 provides an adjustable strap 181 and is located at the distal end 129 of the frame 104 upon handle 101. A tension measurement and display device 119, such as a force gauge, may be incorporated in the handle 101 for measuring the tension applied to the patient's leg.

The upper extremity or thigh of the patient's supported leg is attached to the frame 104 with a perennial saddle 102 and a removable strap (which cradles the patient's leg similar to cradle 10 of FIGS. 1–2). The saddle 102 may be pivotally attached to the proximal end 128 of the frame 104 and constructed of pliable material, such as of aluminum and canvas, for form fitting to the contour of the patient's thigh. Applied forces may be transmitted evenly across the area of the patient's thigh engaged by the saddle 102 to minimize the possibility of tissue damage.

The frame 104 is supported in an annular opening 150 in a connector 117, which holds a horizontal bar 113 in perpendicular relationship with the frame 104. The frame may be pivoted around point 188, where the horizontal bar 113 freely rotates within an annular opening 151 in the connector 117. A pair of vertical bars 153, 154, rigidly connected to the bar 113 on either side of the connector 117, may be attached to the operating table with a pair of clamps 186.

When downward force is applied to the distal end 129 of the frame 104, the frame 104 pivots about point 188. As a result, the patient's supported thigh is forced upward at the proximal end 128 of the frame 104. As the frame 104 pivots, a pair of struts 195, 196, pivotally connected at their lower ends to the vertical bars 153,154, push a ratchet sleeve 131, to which they are pivotally connected at their upper ends, distally over a plurality of angled teeth 189 on the frame 104. A spring-loaded pawl 132, attached to the sleeve 131, locks the sleeve 131 and the struts 135, 136 in an extended position on the frame 104 relative to the connector 117, therefore locking the frame 104 in a pivoted position.

The frame 104 and the patient's leg may be lowered by releasing the pawl 132 on the sleeve 131 from the frame 104 by sliding a tube 112 proximally along frame 104 to disengage the pawl 132 from the teeth 189.

Axial translation of the patient's leg relative to the pelvis is induced by distally pulling the handle 101, which is connected to a screw 133 telescopically engaged in the extreme distal end 129 of the frame 104. Since the perennial saddle 102 is pivotable and its strap adjustable, the entire supported leg of the patient may be translated when the lower extremity of the leg is pulled distally. The translated position can be automatically locked by a pawl (not shown) connected to the distal end of the frame 104 that engages the most proximally exposed thread of the screw 133. Additional translation may be induced by rotating crank 107 connected to the distal end of the screw 133, allowing the screw to move and lock distally in the threaded grooves of the pawl.

The combination of upward force on the patient's femur by the perennial saddle 102 when the frame 104 is pivoted and the axial translation of the patient's leg provides the desired distraction force and angle of distraction at the hip joint.

The patient's leg may be rotated relative to the pelvis to arthroscopically view the joint surfaces and the load bearing surface of the femoral head by rotating the frame 104 within the connector 117 with a rotation handle 108 when a rotational locking sleeve 110 is disengaged. The rotational locking sleeve 110 extends over a portion of the frame 104 and locks the frame 104 in rotational relationship with the connector 117. At its distal end, the locking sleeve 110 is releasably connected with the rotation handle 108 by one or more spring-loaded tension grips 141. The sleeve 110 has seating ridges 143 that engage recesses 144 on the distal face of the connector 117. The tension grips 141 maintain axial tension on the locking sleeve 110, thus forcing the locking sleeve 110 to abut and register with the connector 117.

The rotational position of the locking sleeve 110 can be fixed relative to the connector 117 by use of a transverse locking pin. When the tension grips 141 are compressed against the rotation handle 108, the ridges 143 disengage from the recesses 144 allowing the locking sleeve 110 to slide distally along the frame 104.

The frame 104 and the patient's leg may then be rotated by rotating the rotation handle 108. The desired position of the frame 104 and patient's leg may be locked by releasing the tension grips 141 to reengage the ridges 143 into the recesses 144.

Thus, the apparatus is useful in supporting and distracting a patient's leg to enable a physician to have improved access to the surfaces of the hip joint and femoral head. The apparatus allows the physician, through the application of controlled force, to maneuver the patient's leg through a full range of motion so a thorough examination is possible.

The foregoing description is illustrative of the present invention but not considered to be limiting. Numerous variations and modifications may be effected without departing from the true scope and spirit of the invention, all of which are contemplated as falling within the scope of the appended claims.

What is claimed is:

1. An apparatus for positioning a leg of a patient relative to his or her pelvis and an operating table upon which the patient is located during surgery, comprising:

(a) a pivotable support for holding the leg of the patient, said support having a distal end and a proximal end and being adapted for positioning to engage a medial side of the patient's leg with the patient's thigh at the proximal end;

(b) means for moving the distal end of the support means so that the patient's leg can be adjusted relative to the operating table for selectively positioning the patient's leg relative to the patient's pelvis;

(c) means for securing the support means in a fixed position relative to the operating table;

(d) wherein the moving means comprises a pair of mounting members with a plurality of vertically aligned notches for adjusting the height of the support means relative to the operating table, and a pair of seating members adjustably connected to the frame and adapted to fit in the mounting member notches; and (e) wherein the means for moving the distal end of the support means comprises a cable releasably connected between the frame and the operating table, and the means for securing the support means in position relative to the operating table includes a fastening element connected to the frame for holding the cable in tension.

2. The apparatus of claim 1, and further including adjustment means for axially translating the leg of a patient relative to the patient's pelvis.

3. The apparatus of claim 2, wherein the adjustment means comprises a rotatable handle and screw connected to the support means.

4. The apparatus of claim 1, wherein the adjustment means further comprises a threaded member moveable on the screw and connected to the seating members.

5. The apparatus of claim 1, further comprising means for selectively rotating the leg of a patient relative to the patient's pelvis for exposing inner surfaces of a hip joint of the patient.

6. The apparatus of claim 4, further including a rotatable, locking wire guide mounted on the support means, and a freely rotatable wire guide connected to a spring and compressor and mounted on the support means.

7. The apparatus of claim 1, wherein the support means includes a bar-like frame, means for engaging the leg of a patient and pivot means.

8. The apparatus of claim 6, wherein the thigh attachment element comprises a flexible member movably connected to the frame and an adjustable strap, and the foot attachment element comprises a cuff-like member adjustably connected to the frame and an adjustable strap.

9. The apparatus of claim 6, wherein the thigh attachment element comprises a first flexible member connected with the frame for supporting the patient's thigh and a second flexible member connected with the operating table for supporting the patient's crotch, and the foot attachment element comprises a cuff-like member adjustably connected to the frame and an adjustable strap.

10. The apparatus of claim 8, wherein the means for moving the distal end of the support means comprises a handle connected to the support means, and the means for securing the support means in position relative to the operating table comprises at least one cross member movably connected with the distal end of the frame and pivotally connected to the vertical member.

11. The apparatus of claim 9, wherein the means for securing the support means further comprises a ratcheting member, a plurality of sloping teeth on the frame in the proximity of the ratcheting member, a pawl connected to the ratcheting member for engaging the teeth and a pawl release member for disengaging the securing means.

12. The apparatus of claim 9, further comprising adjustment means for axially translating the patient's leg relative to the patient's pelvis and means for rotating the patient's leg relative to the patient's pelvis for exposing inner surfaces of a hip joint of the patient.

13. The apparatus of claim 10, wherein the adjustment means comprises a screw rigidly connected to the foot attachment means and telescopically engageable in the distal end of the frame and a locking element for fixing the position of the screw relative to the frame.

14. The apparatus of claim 10, wherein the means for rotating the patient's leg comprises a handle rigidly connected to the frame and a rotational locking element for varying the position of the frame relative to the connecting element.

15. The apparatus of claim 12, wherein the rotational locking element comprises a sleeve connected with the frame between the connecting element and the handle, and means for engaging the sleeve with the connecting element.

16. The apparatus of claim 13, wherein the means for engaging the sleeve with the connecting element comprises a pin extending from the sleeve, at least two grooves formed in the connecting element for accepting the pin and a tension release member connected between the sleeve and the handle.

17. The apparatus of claim 1, further including a clamping element for removably connecting the support means to the operating table.

18. The apparatus of claim 15, further including means for measuring and displaying tension placed on patient's leg.

19. The apparatus of claim 16, further including a high friction pad placed between the patient and operating table to prevent patient slippage along the table.

20. The apparatus of claim 17, further including a pelvic anchor element for releasably securing the patient's pelvis relative to the operating table.

21. An apparatus for positioning a leg of a patient relative to his or her pelvis and an operating table upon which the patient is located during surgery, comprising:

(a) pivotable support means for holding the leg of the patient, said support means having a distal end and a proximal end and being adapted for positioning to engage a medial side of the patient's leg with the patient's thigh at the proximal end;

(b) means for moving the distal end of the support means so that the patient's leg can be adjusted relative to the operating table for selectively positioning the patient's leg relative to the patient's pelvis;

(c) means for securing the support means in a fixed position relative to the operating table;

(d) wherein the pivotable support means includes a member connected between the operating table and the frame;

(e) adjustment means for axially translating the leg of the patient relative to the patient's pelvis;

(f) wherein the adjustment means comprises a rotatable handle and screw connected to the support means; and (g) wherein the means for moving includes a tension wire for placing tension on the support means.

22. The apparatus of claim 21, wherein the means for engaging the leg of a patient comprises a thigh attachment element for holding the patient's thigh at the proximal end of the frame and a foot attachment element for holding the patient's foot at the distal end of the frame.

23. The apparatus of claim 21, wherein the pivot means comprises a member extending perpendicular to and pivotally connected with the frame and connected with the operating table by at least one vertical member.

24. An apparatus for positioning a leg of a patient relative to a pelvis of the patient and an operating table upon which the patient is located during surgery, the patient's leg having a distal extremity including a foot and a proximal end including a thigh, comprising:

(a) a cradle-like support member for holding the patient's leg, the support member having a distal end located to be adjacent a medial side of the patient's foot and a proximal end located to be adjacent a medial side of the patient's thigh, the support member being adapted for positioning to engage a substantial portion of a medial side of the patient's leg;

(b) a linkage adjustably connected to the support member for axially translating the patient's leg relative to the patient's pelvis;

(c) a movable member movably connected between the support member and an operating table upon which the patient is located;

(d) a cable releasably connected between the distal end of the support member and an operating table;

(e) a cable locking member connected to the support member to secure the support member in position relative to an operating table;

(f) a tension wire movably connected between the support member and the movable member to allow the support member to be rotated relative to the patient's pelvis to expose inner surfaces of a hip joint of the patient; and (g) a pelvic anchor member for securing the position of the patient's pelvis relative to an operating table.

25. An apparatus for positioning a leg of a patient relative to a pelvis of the patient and an operating table upon which the patient is located during surgery, the patient's leg having a distal extremity including a foot and a proximal end including a thigh, comprising:

(a) a bar-like support member for holding the patient's leg, the support member having a distal end located to be adjacent a medial side of the patient's foot and a proximal end located to be adjacent a medial side of the patient's thigh, the support member being adapted for positioning to engage a medial side of the patient's leg with a thigh attachment element and a foot attachment element;

(b) an anchor member for securing the position of the patient's pelvis relative to an operating table;

(c) a movable member pivotally connected to the support member with a connector, the movable member having at least one vertical member releasably connected to the operating table and a ratcheting member connected between the vertical member and the support member;

(d) a screw telescopically engaged in the distal end of the support member and rigidly connected to the foot support attachment element for axially translating the patient's leg relative to the patient's pelvis;

(e) a handle connected to the distal end of the support element for rotating the support element relative to the connector for exposing inner surfaces of a hip joint of the patient.

26. The apparatus of claim 25, wherein the anchor member for securing the patient's pelvis comprises in part holding means extending at least partially around the patient's waist and connected to the operating table.

27. The apparatus of claim 25, wherein the support member comprises a cradle-like frame.

28. The apparatus of claim 27, wherein the cradle-like frame comprises a pair of elongated side members, a plurality of cross members, and the means for engaging the leg of a patient comprises a plurality of straps.

29. The apparatus of claim 25, wherein the movable member comprises a pair of mounting members with a plurality of vertically aligned notches for adjusting the height of the movable member relative to the operating table.

30. The apparatus of claim 29, wherein the movable member includes a pair of seating members connected to the support means and adapted to fit in the notches in the mounting members.

31. The apparatus of claim 25, wherein the means for securing the support means in position relative to the operating table includes means for fastening a cord connected to the operating table to the support means.

32. The apparatus of claim 25, further comprising a tension wire extending between the upper and lower portions of the support means for placing tension on the support means.

33. The apparatus of claim 32, further including a tension spring and compressor connected to a wire guide mounted on the cradle-like frame.

34. The apparatus of claim 33, further including a second wire guide mounted on the cradle-like frame and means for selectively locking the second wire guide.

35. The apparatus of claim 25, further comprising adjustment means for axially translating the leg of a patient relative to the patient's pelvis.

36. An apparatus for positioning a patient's leg relative to an operating room table during surgery, comprising:

(a) a pelvic anchor for holding the patient's pelvis on the upper surface of the operating room table in an inclined position relative to the operating room table;

(b) a leg support member supported upon the operating room table for engaging the thigh and foot of the leg of a patient and having a distal end on the side of the patient's foot and n a proximal end on the side of the patient's thigh;

(c) the leg support being shaped to engage one of the patient's legs generally on the side facing the other leg;

(d) the leg support including a pivot;

(e) means for enabling the distal end of the leg support to be rotated so that the outer extremity of the patient's leg can be adjusted relative to the operating table for selectively positioning the leg relative to the pelvis;

(f) an attachment for securing the leg support in a desired position relative to the operating table;

(g) wherein the leg support includes a frame with a central bar-like member and a sling for engaging the leg of a patient; and (h) wherein the leg support includes an attachment that can be removably affixed to the thigh of a patient's leg at the proximal end of the support and an attachment that can be removably affixed to the patient's foot at the distal end of the leg support.

37. The apparatus of claim 36, wherein the pivot comprises an inverted U-shaped member connected to the leg support with a coupler rotatable relative to the inverted U-shaped member.

38. The apparatus of claim 36, further comprising a handle connected to the leg support for enabling a user to move the leg support.

39. The apparatus of claim 36, and further including means for removably connecting the support means to an operating table which comprises clamp means for engaging the operating table.

40. The apparatus of claim 36, and further including means for measuring and displaying tension placed on the leg of a patient.

41. An apparatus for positioning a patient's leg relative to an operating room table during surgery, comprising:

(a) a pelvic anchor for holding the patient's pelvis on the upper surface of the operating room table in an inclined position relative to the operating room table;

(b) a leg support member supported upon the operating room table for engaging the thigh and foot of the leg of a patient and having a distal end on the side of the patient's foot and a proximal end on the side of the patient's thigh;

(c) the leg support being shaped to engage one of the patient's legs generally on the side facing the other leg;

(d) the leg support including a pivot that includes an inverted U-shaped member;

(e) means for enabling the distal end of the leg support to be rotated so that the outer extremity of the patient's leg can be adjusted relative to the operating table for selectively positioning the leg relative to the pelvis;

(f) an attachment for securing the leg support in a desired position relative to the operating table;

(g) wherein the leg support includes a frame with a central bar-like member and a sling for engaging the leg of a patient;

(h) wherein the leg support includes an attachment that can be removably affixed to the thigh of a patient's leg at the proximal end of the support and an attachment that can be removably affixed to the patient's foot at the distal end of the leg support; and (i) a pair of cross members connected to the leg support with a ratcheting member and each cross member is pivotally connected to the inverted U-shaped member.

42. An apparatus for positioning a patient's leg relative to an operating room table during surgery, comprising:

(a) a pelvic anchor for holding the patient's pelvis on the upper surface of the operating room table in an inclined position relative to the operating room table;

(b) a leg support member supported upon the operating room table for engaging the thigh and foot of the leg of a patient and having a distal end on the side of the patient's foot and a proximal end on the side of the patient's thigh;

(c) the leg support being shaped to engage one of the patient's legs generally on the side facing the other leg;

(d) the leg support including a pivot;

(e) means for enabling the distal end of the leg support to be rotated so that the outer extremity of the patient's leg can be adjusted relative to the operating table for selectively positioning the leg relative to the pelvis;

(f) an attachment for securing the leg support in a desired position relative to the operating table;

(g) an adjustment for axially translating the leg of a patient relative to the patient's pelvis; and (h) a plurality of sloping teeth on the leg support, a pawl connected to the ratcheting member and a disengaging sleeve slidable over the support member.

43. An apparatus for positioning a patient's leg relative to an operating room table during surgery, comprising:

(a) a pelvic anchor for holding the patient's pelvis on the upper surface of the operating room table in an inclined position relative to the operating room table;

(b) a leg support member supported upon the operating room table for engaging the thigh and foot of the leg of a patient and having a distal end on the side of the patient's foot and a proximal end on the side of the patient's thigh;

(c) the leg support being shaped to engage one of the patient's legs generally on the side facing the other leg;

(d) the leg support including a pivot;

(e) means for enabling the distal end of the leg support to be rotated so that the outer extremity of the patient's leg can be adjusted relative to the operating table for selectively positioning the leg relative to the pelvis;

(f) an attachment for securing the leg support in a desired position relative to the operating table;

(g) wherein the leg support includes a frame with a central bar-like member and a sling for engaging the leg of a patient;

(h) wherein the leg support includes an attachment that can be removably affixed to the thigh of a patient's leg at the proximal end of the support and an attachment that can be removably affixed to the patient's foot at the distal end of the leg support; and (i) an adjustment for axially translating the leg of a patient relative to the patient's pelvis.

44. The apparatus of claim 43, wherein the adjustment comprises a rotatable handle and screw connecting the leg support and means for locking the screw in position relative to the leg support.

45. The apparatus of claim 44, wherein the means for locking the screw comprises a pawl connected to the leg support.

46. The apparatus of claim 43, wherein the adjustment comprises a bar rigidly connected to the attachment to the patient's foot and telescopically connected to the leg support, and means for locking the bar in position relative to the support means.

47. The apparatus of claim 46, wherein the means for locking the screw comprises a pawl connected to the support means.

48. An apparatus for positioning a patient's leg relative to an operating room table during surgery, comprising:

(a) a pelvic anchor for holding the patient's pelvis on the upper surface of the operating room table in an inclined position relative to the operating room table;

(b) a leg support member supported upon the operating room table for engaging the thigh and foot of the leg of a patient and having a distal end on the side of the patient's foot and a proximal end on the side of the patient's thigh;

(c) the leg support being shaped to engage one of the patient's legs generally on the side facing the other leg;

(d) the leg support including a pivot; and (e) a leg position adjustment for enabling the distal end of the leg support to be rotated so that the outer extremity of the patient's leg can be selectively rotated relative to the patient's pelvis.

49. The apparatus of claim 48, wherein the means for rotating the patient's leg comprises a handle connected to the support means with retracting means for changing the position of the support means relative to the pivot means.

50. The apparatus of claim 49, wherein the retracting means comprises a sleeve rigidly attached to the support means with a pin at its proximal end engageable in any among a plurality of circumferentially arranged holes in end of a coupler that connects the support means with the pivot means and means for disengaging the sleeve from the coupler.

51. The apparatus of claim 50, wherein the means for disengaging the sleeve from the coupler comprises a pressure release member disposed between the handle and the sleeve.

52. A method for supporting the leg of a patient and distracting said leg from the patient's hip joint during surgery wherein the patient's pelvis is supported in a transversely inclined position upon an operating room table surface, comprising the steps of:

(a) positioning the patient on an operating table in a position that places one of the patient's hips against the table surface and inclines the patient's pelvis so that one of the patient's legs is elevated above the other of the patient's legs;

(b) mounting the elevated leg to a support frame, the distal end of the support frame on the side of the patient's foot and the proximal end of the support frame on the side of the patient's thigh, the support frame pivotally moveable relative to the operating table;

(c) moving the distal end of the support frame relative to the operating table around a pivot point that enables the hip joint of the elevated leg to be distracted; and (d) securing the support frame in a desired position relative to the operating table.

53. The method of claim 52, further including securing the patient's pelvis relative to the operating table with an anchor.

54. The method of claim 52, further including the step of axially translating the leg of a patient relative to the patient's pelvis by moving linkage connected to the support frame.

55. The method of claim 52, further including the step of placing tension on the support frame to allow the leg to be selectively rotated by adjusting a tension compressor and spring connected to a tension wire extending between the upper and lower portions of the support frame.

56. The method of claim 52, further including manually rotating the limb support frame to overcome the tension placed upon it for exposing the inner surface of a patient's hip joint and selectively locking the tension wire to fix the position of the support frame.

57. The method of claim 52, further including the step of manually rotating the limb support frame and locking the position of the support frame relative to the operating table by engaging a pin connected to the limb support frame to a coupler that holds the frame in position relative to the operating table.

58. The method of claim 52 wherein in step "c" the femoral head is pulled out of the acetabular cut through lever action of the support frame moving relative to the operating room table.

59. The method of claim 58 wherein in step "c" the pivot is below the hip joint.

60. The method of claim 52 further comprising the step of using a cable to control the location of the frame relative to the operating room table.

61. The method of claim 52 further comprising the step of exposing various surfaces of the hip joint using rotation approximately about the long axis of the leg.

62. The method of claim 52 further comprising the step of placing axial force to the patient's foot.

63. The method of claim 52 further comprising the step of preventing the patient's pelvis from moving relative to the operating room table.

* * * * *